United States Patent [19]

Elrich

[11] 4,215,707

[45] Aug. 5, 1980

[54] WATER PIPE

[76] Inventor: Joshua D. Elrich, 2302 Coleridge Dr., Silver Spring, Md. 20910

[21] Appl. No.: 934,621

[22] Filed: Aug. 17, 1978

[51] Int. Cl.[2] ..... A24F 1/30; A24F 3/02

[52] U.S. Cl. ..... 131/173; 131/183

[58] Field of Search ..... 131/173, 182, 183, 221, 131/222, 223, 224, 226, 231

[56] References Cited

U.S. PATENT DOCUMENTS 1,967,438 7/1934 Hartzes ..... 131/173

FOREIGN PATENT DOCUMENTS 107388 3/1899 Fed. Rep. of Germany ..... 131/173

828933 1/1952 Fed. Rep. of Germany ..... 131/173

*Primary Examiner*—Stephen C. Pellegrino

*Attorney, Agent, or Firm*—Spencer & Kaye

[57] ABSTRACT

A bowl for holding a charge of smoking substance in a water pipe and composed of a housing provided with a through bore defining a smoke passage and a movable member defining the base of a cavity for holding the smoking substance and movable between a first position in which it presents a surface for supporting the charge of smoking substance while permitting smoke and air to pass through the bore, and a second position in which it presents a passage for the fall of ashes and debris from the cavity. The water pipe vessel is provided with thermal insulation to keep the water warm. The tube for delivering smoke into the water can end in an extension which projects into the water and has a plurality of openings to establish a large area of contact between the smoke and the water.

8 Claims, 5 Drawing Figures

WATER PIPE

BACKGROUND OF THE INVENTION

The present invention relates to water pipes, of the bong or toker type, and particularly to a bowl therefor.

Such pipes include, as the central component, a vessel provided with two openings arranged to be filled with water to a level such that the water blocks the path between the two openings. One opening is provided with a tube formed to receive a bowl for holding the smoking substance, while the other opening forms a passage with which the smoker's mouth is to communicate. The outlet end of this passage may have a large diameter and be shaped to surround the smoker's mouth, or may have the form of an ordinary mouthpiece. Either one of the openings is usually at the top of the vessel, while the other is usually located in the vessel side wall.

The bowl for holding the smoking substance normally has a small hole, typically of the order of one-eighth inch diameter, at its bottom for the passage of air and smoke, as well as ashes. This hole is dimensioned to support a charge of smoking substance and regularly becomes clogged, requiring use of a poker of one type or another for clearing the hole. Moreover, when a charge of smoking substance has been used up, the remaining ashes, unburned material and residues must be cleared out, either by pushing it through the hole or by dumping or scraping it out of the bowl.

In addition, it is generally considered desirable to have the water in the vessel at a low temperature in order to cool, and thereby smooth, the smoke. Therefore, efforts are made to cause the thermal conductivity of the vessel to be as high as possible so that any tendency of the water to become heated will be opposed by heat conduction through the vessel walls.

SUMMARY OF THE INVENTION

It is an object of the present invention to improve the operation of such pipes.

A further object of the invention is to facilitate the use of such pipes, and particularly cleaning out of the bowl.

Another object of the invention is to permit the flow of smoke and air to be temporarily increased, particularly at the end of smoking of a charge of smoking substance.

The above objects are achieved, according to the invention, by providing the bowl with a movable member which defines the base of the cavity for holding the charge of smoking substance and which is easily movable between a first position in which it acts like a screen in that it presents a supporting surface and permits a normal flow of air through the substance, and a second position in which it presents a passage for the fall of ashes and debris into the water or an ash-trap and permits an increased flow of air and smoke.

An additional object of the invention is to reduce the harshness of the smoke.

In order to achieve this object, based on applicant's discovery that, contrary to conventional wisdom in the art, the harshness of the smoke will be less if the water is warm, the vessel is provided with an insulating layer, as a liner or shell, to prevent the water from cooling so that the water in the vessel is either maintained at an initial warm temperature or is at least permitted to warm up during use.

Yet another object of the invention is to increase the extent of contact between the smoke and the water.

This object is achieved, according to one embodiment of the invention, by providing the tube which receives the bowl with an extension which projects into the vessel below the water level, the free end of the extension being closed and the lateral walls thereof being provided with a plurality of openings all located below the water level and among which the smoke is distributed so as to establish more extensive contact with the water in the vessel.

In a preferred form of construction for the bowl according to the invention, at least the lower part of the cavity has a cylindrical form and the movable member is provided with a cylindrical bore which will be aligned with the bottom of the cavity when the movable member is in its second position. One advantage of this arrangement is that the bore, and possibly the lower part of the cavity, can have a diameter corresponding to that of a cigarette, which could then be inserted into the cavity and the movable member and be smoked via the water pipe. It would also be possible to dimension the upper part of the cavity to hold a cigarette.

DESCRIPTION OF THE PREFERRED EMBODIMENTS

Figure 1:
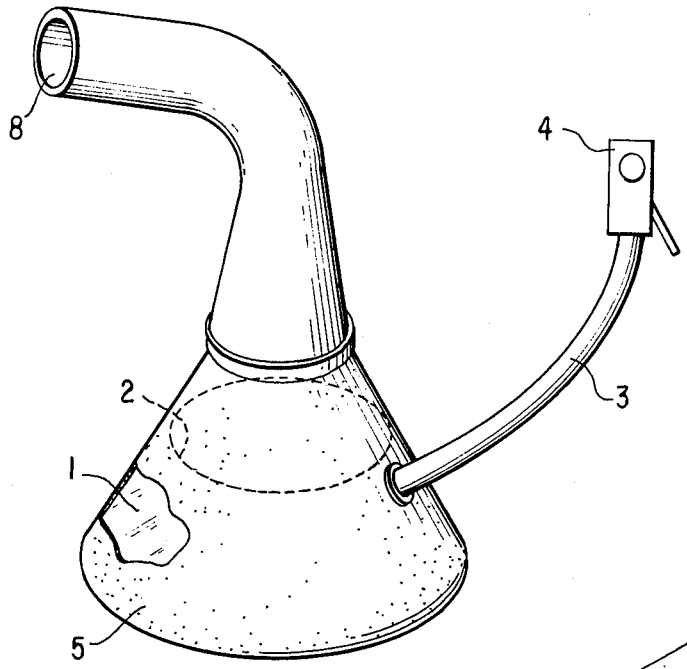
FIG. 1 is a perspective view of a preferred embodiment of the toker-type bong according to the present invention.

FIG. 1 illustrates a bong composed of a vessel 1 provided in its side wall with an opening via which a tube 3 communicates with the interior of the vessel. The top of the vessel presents a second opening in the form of a passage into the free end 8 of which the smoker's mouth will be placed.

The free end of tube 3 is surmounted by a bowl 4 presenting a cavity in which the smoking substance will be placed.

The vessel is arranged to be filled with water up to, for example, a level 2 so that any smoke traveling from the bowl 4 to the opening 8 must pass through the water.

In accordance with one aspect of the present invention, the vessel is enclosed with an insulating shell 5, for example of styrofoam, in order to keep the water filling the vessel warm. The thickness of shell 5 is not critical and need only be sufficient to prevent any appreciable conduction of heat out of the vessel.

Figure 2:
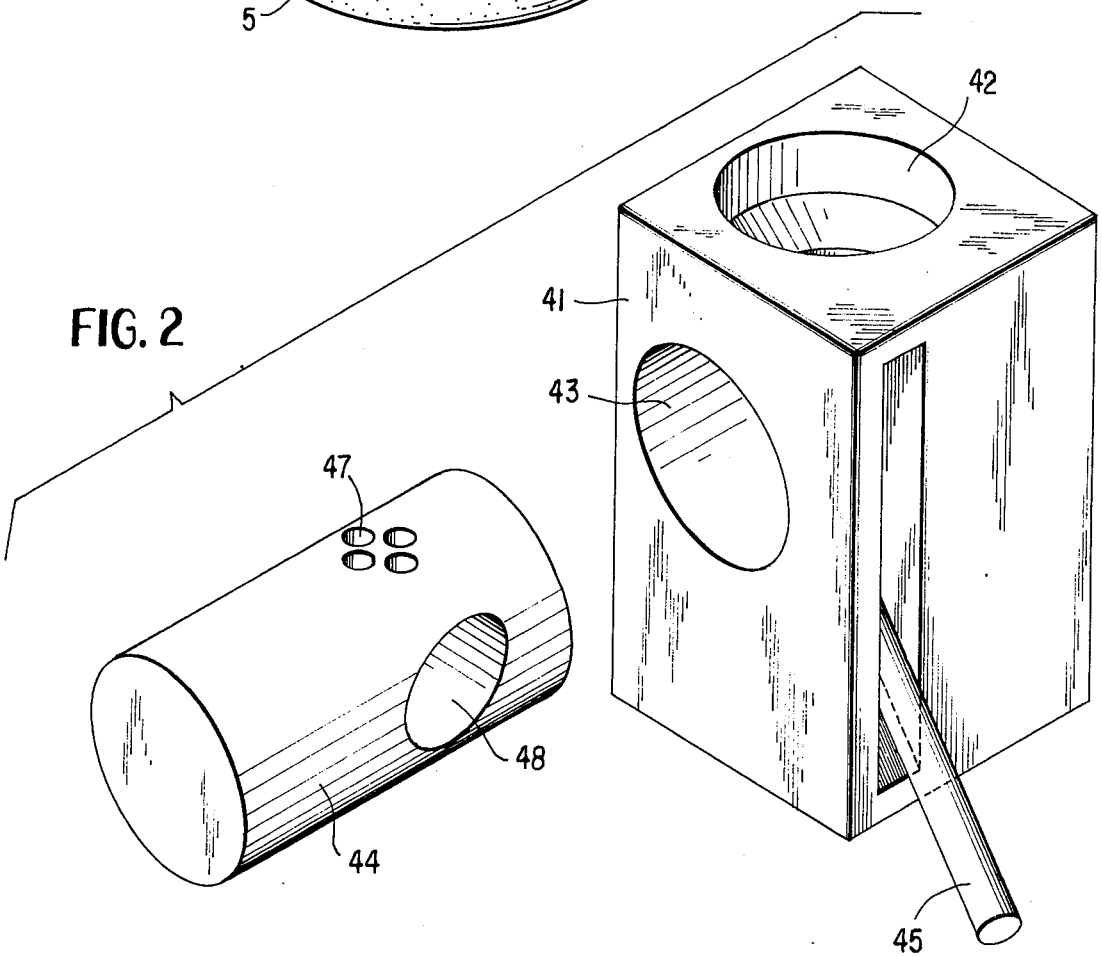
FIG. 2 is an exploded perspective view of a preferred embodiment of a bowl according to the invention provided on the bong of FIG. 1.
Figure 3:
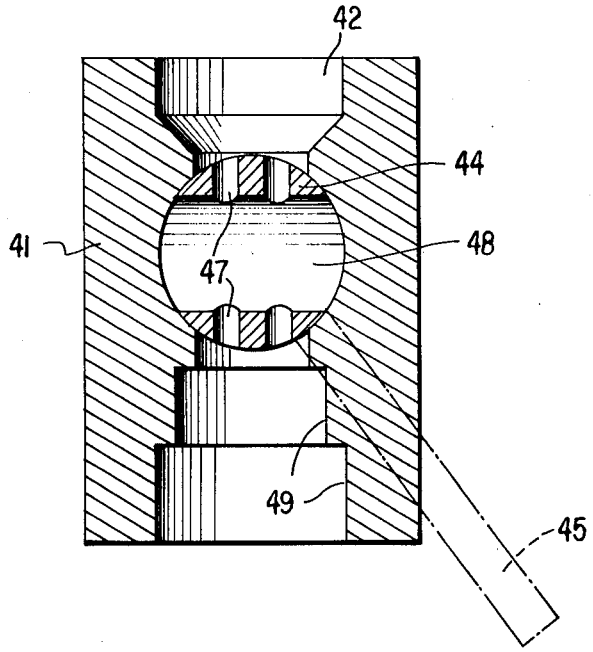
FIG. 3 is a cross-sectional elevational view of the bowl of FIG. 2 in its assembled state.

One embodiment of the bowl 4 according to the present invention is shown in FIGS. 2 and 3. This includes a housing 41 provided at its top with a recess, or cavity, for receiving a charge of smoking substance. Housing 41 is further provided with a bore 43 extending transverse to recess 42 and arranged to receive a cylindrical valve member 44. Valve member 44 is formed to have a transverse through bore 48 of relatively large diameter, with the axis of bore 48 intersecting the axis of cylindrical valve member 44.

Member 44 is further provided with an array of comparatively small holes 47 extending through the entire diameter of member 44 and oriented substantially perpendicular to bore 48. Finally, member 44 is provided with a radially extending blind bore for receiving a lever arm 45.

When bowl 4 is in its assembled condition, valve member 44 is inserted into bore 43 so that the diametral plane bisecting bore 48 and the array of holes 47 is substantially aligned with the axis of recess 42 and lever 45 engages in the blind bore in member 44, arm 45 extending through a slot provided in the side wall of housing 41.

When valve member 44 is in the angular position shown in FIG. 3, the valve member presents a support surface for a charge of smoking substance introduced into the recess 42, and the small holes 47, which, in effect, traverse bore 48, define a perforate support, or screen, surface for supporting the smoking substance while providing a passage for air and smoke.

When, on the other hand, valve member 44 is pivoted through an angle of 90° from the position shown in FIG. 3, by shifting lever 45, the large bore 48 comes into alignment with cavity 42, thereby providing a clearing position which permits increased air flow while simultaneously causing ash, debris, and any remaining smoking substance to be dumped into receptacle 1.

As is also apparent from FIG. 3, the bottom of housing 41 is provided with a stepped recess 49 permitting the housing to be seated on tubes 3 having different diameters.

Figure 4:
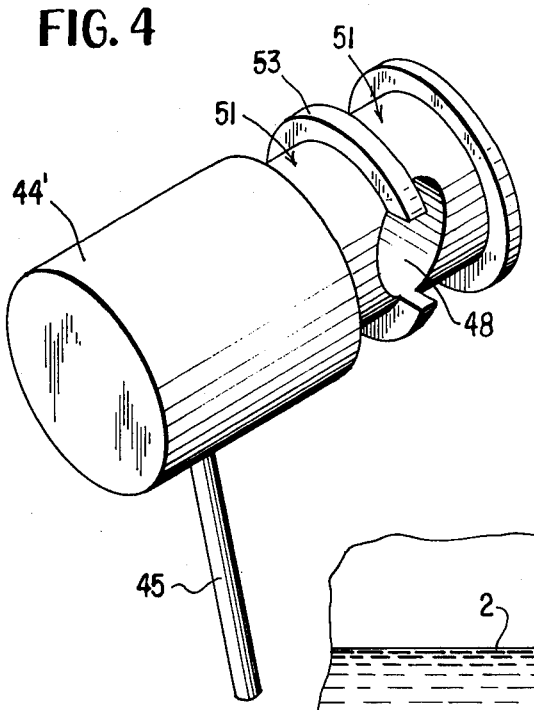
FIG. 4 is a perspective detail view of a modified form of construction of the valve of a bowl according to the present invention.

Another embodiment of the valve is shown in FIG. 4, which illustrates a valve member 44' having, in place of the small holes 47, a pair of circular grooves 51 separated by a ridge, or land, 53. Land 53, which can be given any desired width, acts to support the charge of smoking substance above the bottoms of grooves 51, so that the latter will provide passages for air and smoke when the valve member is in the normal smoking position. The embodiment shown in FIG. 4 offers the advantage that its manufacture requires only a small number of machine operations.

The structural arrangements shown in FIGS. 2–4 are such that the valve member is in its normal smoking position when the associated lever 44 is pointing downwardly. Therefore, the valve member will be automatically maintained in this position and the lever arm 45 need only be held by the smoker when the valve member is to be pivoted into, and held in, its clearing position, which is normally retained only for a short period of time. If it were desired to retain the valve member in this clearing position for an extended period of time, the various components could be dimensioned to retain the valve member in this position under the influence of friction forces. It would also be possible to construct the valve member so that it is in its normal smoking position when the lever arm 45 is pointing upwardly, in which case a return spring could be connected between the lever arm and housing 41 in order to retain the valve member in the smoking position. The user would then push the lever 45 downwardly against the action of the return spring in order to bring the valve member into its clearing position.

Figure 5:
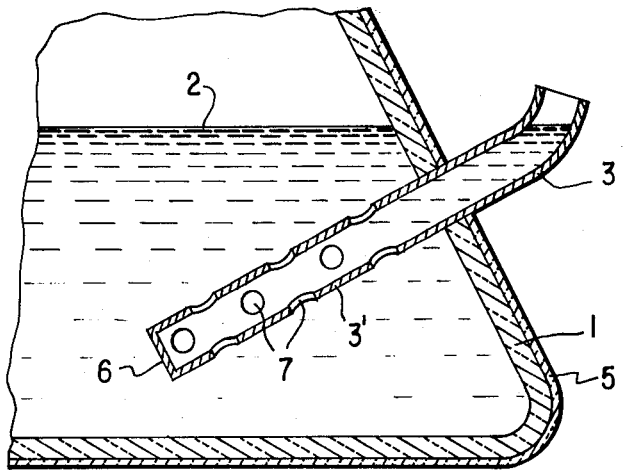
FIG. 5 is a cross-sectional detail view of a portion of a bong provided with a smoke-conducting tube according to an embodiment of the invention.

According to a further feature of the invention, as illustrated in FIG. 5, tube 3 is provided with an extension 3' which projects into vessel 1 in a region below water level 2. The free end of the extension is closed by an end wall 6, while the side wall of the extension is provided with a plurality of openings 7. Smoke from the bowl surmounting the outer end of tube 3 will initially pass through water filling the lower end of tube 3 and extension 3' and will then be distributed among the openings 7 so as to create an extensive area of contact between the smoke and the main body of water filling vessel 1. As a result, the filtering action performed by the water will be enhanced. All of the openings 7 should be located below the water level 2 and the number and size of the openings 7 are not critical and can be selected to achieve the desired degree of contact.

It will be understood that the above description of the present invention is susceptible to various modifications, changes and adaptations, and the same are intended to be comprehended within the meaning and range of equivalents of the appended claims.

What is claimed is:

1. A bowl arranged to be associated with a smoking device and presenting a cavity for holding a charge of smoking substance comprising: a housing provided with a through bore defining a smoke passage and one end of said bore defining the lateral walls of the cavity; and a movable member located in said housing and extending across said bore and defining the base of said cavity, said member presenting a large diameter through bore and including means defining a support surface provided with at least one passage smaller in cross section than said through bore in said member, said member being movable between a first position in which said support surface extends across said through bore in said housing for supporting the charge of smoking substance while permitting smoke and air to pass through said passage, and a second position in which said through bore in said member is aligned with said through bore in said housing to present a passage for the fall of ashes and debris from the cavity and through said bores, and out of said housing.

2. An arrangement as defined in claim 1 wherein said housing is provided with a cylindrical recess having an axis which extends transverse to the axis of said through bore, and said movable member is held in said recess for movement between said first and second positions by rotation about the axis of said recess.

3. An arrangement as defined in claim 2 wherein said housing is provided with a slot and said movable member comprises a lever arm extending through said slot for permitting manual movement of said member between its positions.

4. A bowl arranged to be associated with a smoking device and presenting a cavity for holding a charge of smoking substance comprising: a housing provided with a through bore defining a smoke passage and one end of said bore defining the lateral walls of the cavity; and a movable member located in said housing and extending across said bore and defining the base of said cavity, said member being movable between a first position in which it presents a surface for supporting the charge of smoking substance while permitting smoke and air to pass through said bore, and a second position in which it presents a passage for the fall of ashes and debris from the cavity and through the bore, wherein said movable member is provided with a through bore which is aligned with said bore in said housing when said movable member is in its second position and with perforations extending transversely to said through bore in said movable member and located to permit passage of smoke and air when said movable member is in its first position.

5. An arrangement as defined in claim 2 wherein said through bore in said movable member is substantially equal in diameter to said through bore in said housing.

6. An arrangement as defined in claim 2 wherein said movable member is provided with annular grooves separated by a land in the region of said through bore to define said surface for supporting the charge of smoking substance.

7. An arrangement as defined in claim 1 wherein said bowl is arranged to be mounted on the end of a pipe forming part of the smoking device, and the other end of said bore is formed to present a stepped region providing portions with different diameters to permit mounting on pipes having different diameters.

8. An arrangement as defined in claim 1 wherein the smoking device is a water pipe.

* * * * *